US010576344B1

(12) United States Patent
Glenn

(10) Patent No.: US 10,576,344 B1
(45) Date of Patent: Mar. 3, 2020

(54) GOLFBALL REBOUNDER

(71) Applicant: Matthew Glenn, Atlanta, GA (US)

(72) Inventor: Matthew Glenn, Atlanta, GA (US)

( * ) Notice: Subject to any disclaimer, the term of this patent is extended or adjusted under 35 U.S.C. 154(b) by 911 days.

(21) Appl. No.: 13/924,091

(22) Filed: Jun. 21, 2013

(51) Int. Cl.
*A63B 63/00* (2006.01)
*A63B 69/36* (2006.01)
*A63B 71/02* (2006.01)

(52) U.S. Cl.
CPC ..... *A63B 63/003* (2013.01); *A63B 69/3658* (2013.01); *A63B 69/3661* (2013.01); *A63B 71/022* (2013.01)

(58) Field of Classification Search
CPC ..... A63B 69/0097; A63B 63/00
USPC ..... 473/150, 154, 170, 164, 152, 151, 197, 473/434, 435, 454, 421, 196, 481–483, 473/479, 472, 484, 485, 480, 194; 273/395, 396, 390, 407, 410, 386
See application file for complete search history.

(56) References Cited

U.S. PATENT DOCUMENTS 702,828 A * 6/1902 Smith ..... A63B 63/00 473/194
2,301,767 A * 11/1942 Willingham ..... 473/190
3,128,627 A * 4/1964 Harris ..... 473/164
3,367,660 A * 2/1968 Di Maggio ..... 273/404
3,516,675 A * 6/1970 Gregory ..... A63B 24/0021 473/164
4,239,221 A * 12/1980 Griffin ..... A63F 9/0204 273/127 R
4,889,341 A * 12/1989 Walker ..... A63B 63/00 473/165
5,467,990 A * 11/1995 Kitzhaber ..... 473/164
5,478,077 A * 12/1995 Miyahara ..... 473/154
6,357,750 B1 * 3/2002 Lievens ..... A63B 69/0097 273/395
8,496,546 B2 * 7/2013 Bulloch ..... A63B 69/0097 273/395
2003/0203775 A1 * 10/2003 Wong ..... A63B 63/004 473/478
2006/0116225 A1 * 6/2006 Kilpatrick ..... A63B 63/083 473/483
2010/0210377 A1 * 8/2010 Lock ..... A63B 24/0003 473/409

* cited by examiner

*Primary Examiner* — John E Simms, Jr.
*Assistant Examiner* — Rayshun K Peng

(57) ABSTRACT

A golf swing training device is disclosed that will provide instant feedback on the position of the golfer's clubface at impact. The device consists of a rebounding surface enclosed, and attach to a frame with a safety net, a goal, a golf mat to provide a hitting surface, and a ribbon attached from the bottom of the frame to the golf mat for alignment and shot analysis. The rebounding surface faces opposite the goal such that when a practice golf ball hits it, it will land in the goal if struck properly. Its angle may be adjustable to accommodate different clubs for a proper rebound into the goal. The rebounder surface may be made from a foam material with a fabric covering that when struck, leaves an indention for visual target reference, repels the ball, and indicates ball spin by referencing where the ball landed inside or outside the goal.

16 Claims, 5 Drawing Sheets

GOLFBALL REBOUNDER

TECHNICAL FIELD

This disclosure relates generally to the field of golf training equipment.

BACKGROUND

The game of golf is a difficult game to learn. In many cases, individuals that attempt to learn the game of golf end up giving into the frustration of not being able to perform at the level that they believe they are capable of. In order to better an individual's golf game, some type of instruction is typically required. Receiving instruction or lessons on swinging a golf club generally requires access to either a driving range or expensive simulator equipment. Moreover, once an individual has acquired a golf swing, the individual must retain that golf swing by practicing it often. Once again, practicing an acquired golf swing typically requires access to a driving range or an expensive simulator.

Furthermore, golf is a game of inches, and the slightest of adjustments to a golf swing can have a major effect on the accuracy and distance of a golf shot. Some products in the past have tried to solve some of the above problems with little to no positive lasting results. For example, golf nets provide users with a way in which to hit golf balls into a backstop without having to go to a driving range. However, the golf net only serves to simplify the process of gathering hit balls and does not provide a user with immediate feedback of a golf swing. Moreover, users of a golf net are fearful to use the golf net indoors because of the potential to miss the net and cause damage to the interior of a home or building. Furthermore, typical golf nets are not easily set up or broken down, therefore, users are unlikely to set up a golf net indoors.

Golf simulators have attempted to provide golfers with a way in which to practice their golf swings indoors, however, most simulators are not within the budget of most individuals. Furthermore, golf simulators require a large amount of interior space, therefore, a golfer hoping to use a golf simulator in their home will generally have to allocate an entire room to the simulator. The simulator is simply not an option for the majority.

Driving ranges provide golfers with an option for practicing their swing while receiving feedback as to the distance and accuracy of a golf shot. However, driving ranges are expensive, are impacted by weather, and force golfers to set aside time to get out of their house and travel to the range.

U.S. Pat. No. 7,780,540 to Zhou, hereinafter referred to as Zhou, discloses a golf swing practice target panel. While the target panel described in Zhou allows a user to determine the impact location of a golf ball, the target panel described in Zhou does not provide a user with a means for immediately evaluating a golf shot.

Therefore, there remains a need, for a golf swing practice apparatus that meets budgetary constraints of the average user and that can allow a user to practice indoors while receiving immediate feedback as to the accuracy of a golf swing.

BRIEF DESCRIPTION OF THE DRAWINGS

Like reference numbers and designations in the various drawings indicate like elements.

DETAILED DESCRIPTION

Figure 1:
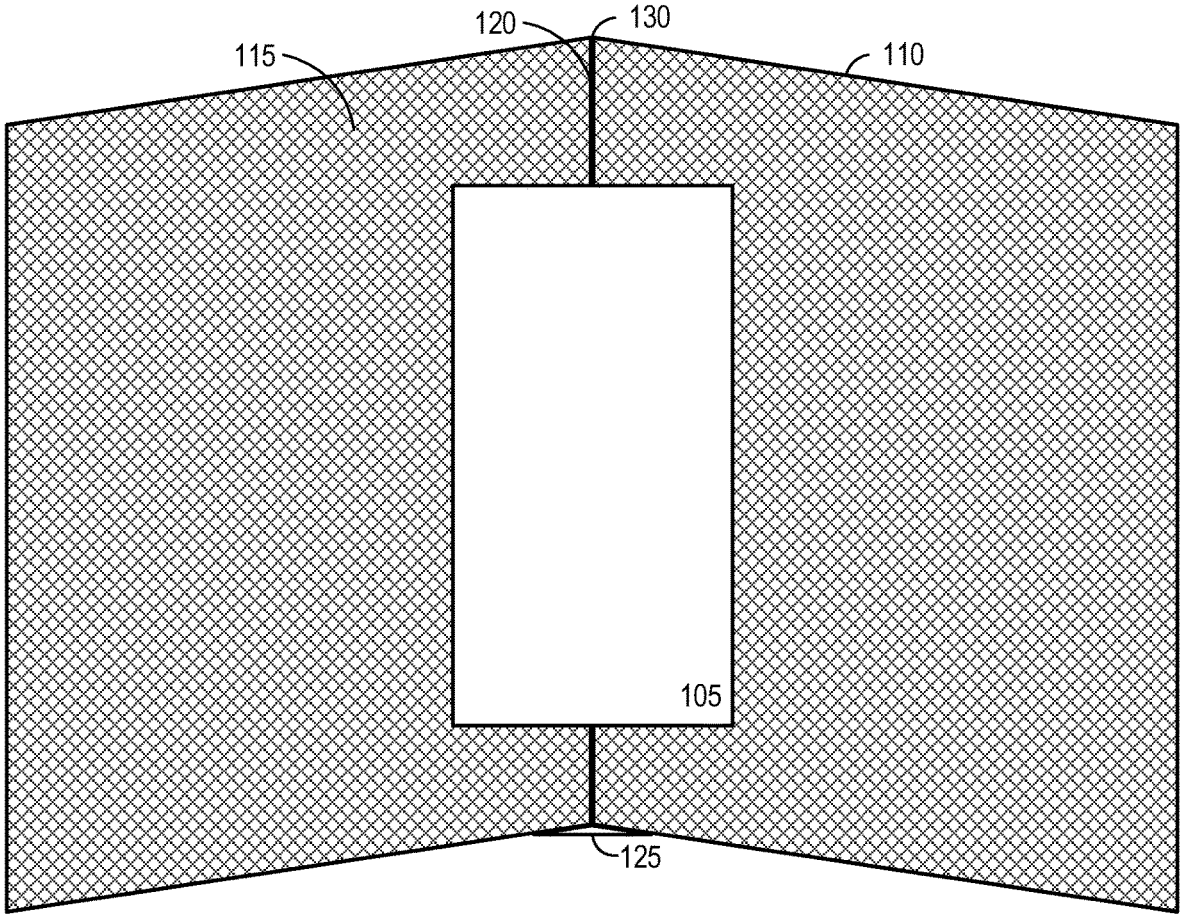
FIG. 1 shows a front view of a rebounder panel and surrounding backstop.

In some implementations of this disclosure, a golf swing practice apparatus can comprise a primary target panel, a surrounding barrier, and a secondary target. The present invention can allow a user to practice a golf swing indoors while receiving immediate feedback as to the accuracy of the golf swing. It is an object of the present invention to allow a golfer to self-train in the comfort of their own home and learn how to develop a pure swing that will propel their golf ball straight down an intended target line with greater frequency and improved accuracy. Once a pure swing is learned, with some level of proficiency, the present invention can also be used to learn how to perform more advanced shots that require placing some spin on a golf ball (e.g., shot shaping, draws, fades, flops, etc.).

It is another object of the present invention to bring people to the game of golf. The present invention can give individuals the opportunity to master a golf swing without suffering from anxiety and costs associated with practicing at a driving range. The present invention solves the problems associated with a driving range by offering the new as well as seasoned golfer the ability to improve, get measurable results, and enjoy the process at the same time.

The present invention provides a user with an objective of rebounding or ricocheting a practice golf ball off of a target panel in the same target line as the user's address target line and land the ball in a secondary target. By landing the ball in the secondary target, a user is given immediate feedback indicating that the ball was struck squarely at impact and produced perpendicular back spin or very little spin, as with some drivers. Balls that are struck with an open or closed club face will rebound off the target panel in the direction opposite to the rotation of the ball, and will, therefore, land to the right or the left of an intended target line (e.g., within or just outside of the secondary target), depending on the direction and extent of side spin enacted on the ball. Clockwise or counter-clockwise horizontal rotation of the ball would indicate, unless intentional, an open or closed club face at impact. An impression can be left on the target panel to indicate where a ball hit the target panel. Based on the direction of ricochet from the target panel and/or the impression left on the target panel, a user can immediately identify off centered shots, shots with clockwise and counter-clockwise horizontal rotation, high launch angles, and low launch angles.

Still other objects of the present invention will become readily apparent to those skilled in the art from the following description, wherein there is shown and described the embodiments of the invention by illustrating the best modes suited to carry out the invention. As will be realized from the following description, the present invention is capable of various other embodiments and its several details are capable of modifications in various aspects without departing from the scope of the invention. Accordingly, the drawing and descriptions will be regarded as illustrative in nature and not as restrictive.

The present invention utilizes the direction of a ball's ricochet from a target panel to force a golfer to focus on target tempo and accuracy. The present invention allows a user to find their optimal target tempo, thereby allowing the user to hit the ball at a maximum swing speed and still be accurate.

The feedback is the key to correcting a golf swing through use of the present invention. The present invention can allow a user to make adjustments to their swing based upon the following feedback received from the present invention: ball trajectory (how high or low on the target panel a ball makes contact); ball flight path (how far off from a target line a ball makes contact with the target panel); ball return flight path (after a ball rebounds off of the target panel, a user can immediately determine what type of spin/rotation (e.g., backspin, clockwise horizontal rotation, counterclockwise horizontal rotation, or a combination thereof) was enacted on the ball at impact with the club); and the extent of spin or rotation that was enacted on the ball at impact with the club head. For example, with extreme back spin, balls will land closer to the target panel, while with less back spin, balls will land further away from the target panel. A ball that is squarely struck, with little to no horizontal rotation enacted on the ball, will rebound off the target panel and into a secondary target, on center or just slightly off center of the secondary target, depending on the initial angle of deflection. As another example, clockwise rotating balls, which produce a fade or a slice, will return off center and closer to the golfer's feet, while counter-clockwise rotating balls, which produce a draw or a hook, will return off center and away from the golfer's feet for a right handed golfer. Without knowing how a ball is spinning after impact by a club face, a golfer has no way of knowing how to correct a miss-hit.

Referring now to the drawings, the following detailed description provides principles and concepts to enable a person skilled in the art to make and use a new golf practice target apparatus. The figures and various drawings, which are not necessarily drawn to scale, are not intended to limit the scope of the present invention. The scope of the present invention includes not only that which is described in this disclosure, but also that which is known in the prior art and alternative embodiments of the present invention which may be contemplated by those skilled in the relevant art and which are taught by this disclosure.

The claimed subject matter is now described with reference to the various figures briefly described above. Throughout the following detailed description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

FIG. 1 shows a front view of a rebounder panel 105 and surrounding backstop 110. The rebounder panel 105 can act as a primary target for a user to attempt to hit with a ball. For example, a user can attempt to hit the rebounder panel 105 with a golf ball. When a ball makes contact with the rebounder panel 105, the ball can ricochet or rebound off of the rebounder panel 105. In some implementations, the rebounder panel 105 can comprise a means for providing a user with feedback as to where a ball impacted the rebounder panel 105. For example, the forward plane of the rebounder panel 105 can be covered with a material (e.g., polyurethane foam, microfiber fabric, etc.) that can be temporarily depressed at a location of impact when a ball impacts the material. A temporary depression at the point of impact in the material covering the rebounder panel 105 can provide a user with a means for analyzing the accuracy and precision of one or more golf shots. In some implementations, the rebounder panel 105 can further comprise an aiming reference point (e.g., a bull's-eye, one or more lines, etc.). For example, the aiming reference point can be printed onto the material covering the rebounder panel 105. A temporary depression at the point of impact in the material covering the rebounder panel 105 can provide a user with a means for analyzing the accuracy of a golf shot based on the position of the temporary depression relative to the aiming reference point.

A user can gather immediate feedback on the flight path of a golf ball based on the way in which the golf ball rebounds off of the rebounder panel 105. When the golf ball rebounds off of the rebounder panel 105, the ball's return flight path can inform a user as to whether there is, back spin, clockwise horizontal rotation, or counter-clockwise horizontal rotation or a combination thereof enacted on the golf ball. Generally, the initial objective for most golfers is a pure shot (e.g., striking a golf ball with a square club face at impact), and the ball's return flight path will immediately allow a user to determine a problem with a golf swing that needs correcting. In some implementations, a user can make corrections in a golf swing based on an impression left on the rebounder panel 105 (e.g., the impression showing exactly where the ball made contact with the rebounder panel 105), and further based upon the ball flight path and ball return flight path.

A variety of types of balls can be used to impact the rebounder panel 105. In some implementations, the golf balls that are used to strike the rebounder panel 105 can be indoor practice golf balls. For example, the golf ball can be a lightweight plastic ball, a heavier plastic or soft rubber ball, and various others.

In some implementations, the rebounder panel 105 can be surrounded by a backstop 110. The backstop 110 can comprise two lateral supports, a top support, and a bottom support. In some implementations, the supports can be made of a rigid, lightweight material (e.g., polyvinyl chloride). It should be understood that the supports can be made of various other materials. In various implementations, the backstop 110 can further comprise a means for stopping or catching a ball that does not impact the rebounder panel 105. For example, a net barrier 115 can encompass the area within the lateral supports, top support, and bottom support. The net barrier 115 can be attached to the lateral supports, the top support, and the bottom support by surrounding each of the supports with the edge gaps in the net barrier 115. It should be understood that the net barrier 115 can be attached to the lateral supports, the top support, and the bottom support in a variety of ways and at various locations (e.g., rivets, ties, straps, etc.).

In an alternative implementation, the backstop 110 can comprise two wing panels (e.g., a left and a right wing panel), a center support 120, a base plate 125, and an upper connector 130. Each of the two wing panels can comprise a lateral support, a top support, and a bottom support. The center support 120 can be attached to a base plate 125 at its lower-end and to an upper connector 130 at its upper-end.

The top supports and bottom supports of each wing panel can be attached to the upper connector 130 and base plate 125 respectively.

In some implementations, the base plate 125 and upper connector 130 can comprise one or more hinges operable to allow the two wing panels to be opened and closed to various angles. For example, a user can fold the two wing panels to a closed position in order to store the present invention and can fold the two wing panels to an open position when the present invention is being put to use.

In some implementations, the backstop 110 can provide a means for holding the rebounder panel 105 in place. For example, the rebounder panel 105 can be attached to the center support 120.

Figure 2:
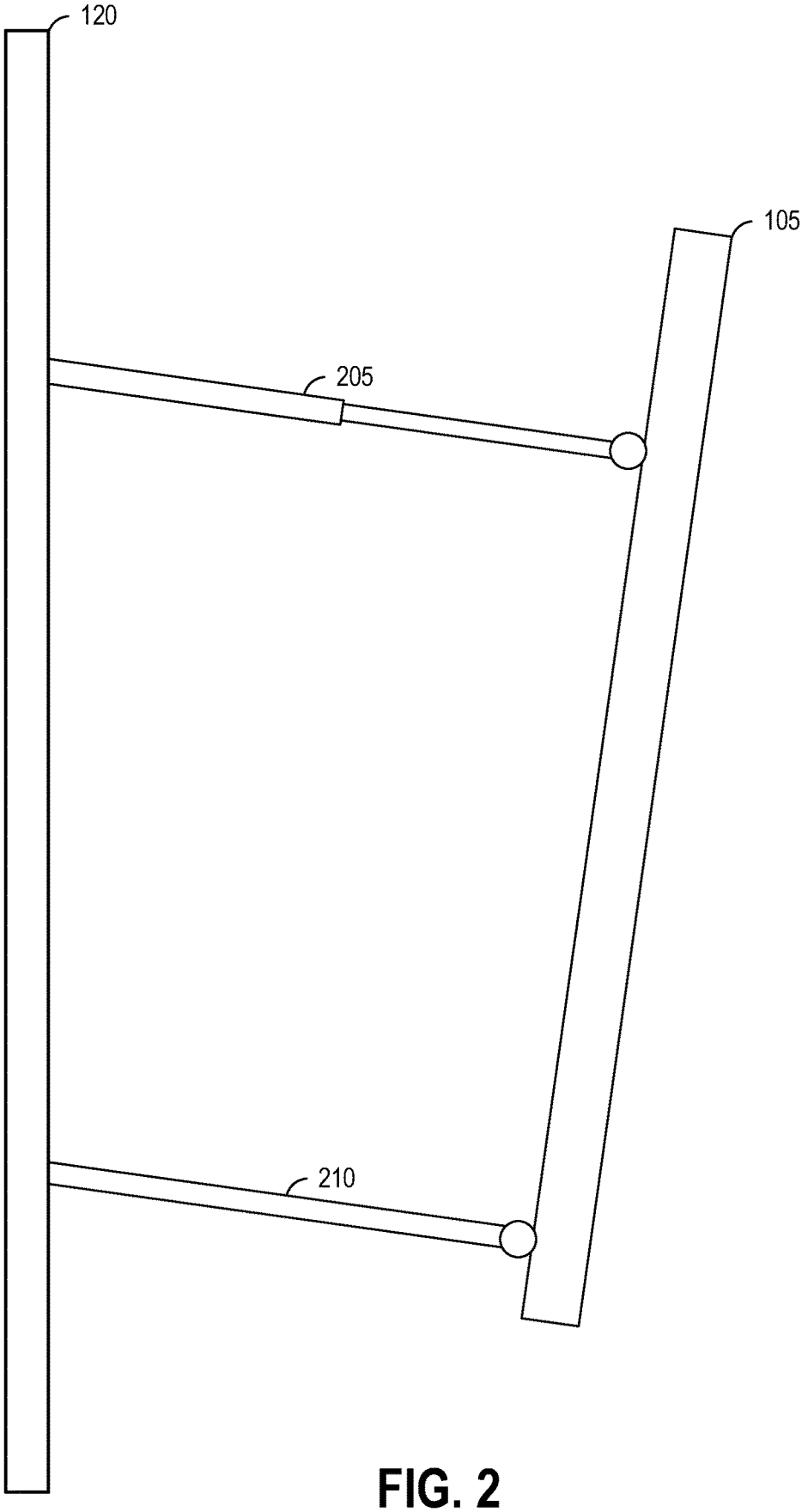
FIG. 2 shows a cross-sectional side view of a rebounder panel and a means for attaching the rebounder panel to a backstop.

FIG. 2 shows a cross-sectional side view of a rebounder panel 105 and a means for attaching the rebounder panel 105 to a backstop. In some implementations, a rebounder panel 105 can be attached to a center support 120 by way of an upper panel support 205 and a lower panel support 210. In various implementations, both the upper panel support 205 and the lower panel support 210 can be a plastic rod of various lengths. For example, the upper panel support 205 can be longer than the lower panel support 210 so that the rebounder panel 105 can be angled toward the ground. In various implementations, both the upper panel support 205 and the lower panel support 210 can be attached at one end to the center support 120 and at the other end to the rebounder panel 105. For example, both the upper panel support 205 and the lower panel support 210 can be attached to the center support 120 by way of a fixed anchor, and both the upper panel support 205 and the lower panel support 210 can be attached to the rebounder panel 105 by way of a hinge that is operable to allow the panel supports to pivot about a horizontal axis passing through each hinge. With the panel supports attached to the rebounder panel 105 by way of a hinge, a user can adjust the angle of the rebounder panel 105 with respect to the ground by altering the length of the upper panel support 205.

In some implementations, the upper panel support 205 can comprise a means for adjusting the length of the upper panel support 205. For example, the upper panel support 205 can be a telescopic rod that can be extended or retracted to various lengths. In various implementations, the upper panel support 205 can be a telescopic rod having a spring loaded pin and multiple holes which can operate to hold the telescopic rod in place when the spring loaded pin is allowed to extend into one of the holes. By adjusting the length of the upper panel support 205, a user can open or close the angle of the rebounder panel 105 relative to the ground.

Safety issues are addressed in the fact that the rebounder panel 105 is angled so that all return ball fight paths, regardless of club or where they hit the rebounder panel 105, rebound toward the ground and do not fly in a direction other than to the floor after impact. Also the angle of deflection can be adjusted to ensure golf balls will rebound properly into a secondary target when struck correctly. Further, the angle of the rebounder panel 105 can be adjusted to accommodate different backspin rates as well as launch angles.

In some implementations, the angle of the rebounder panel 105 can be adjusted based on the loft of a golf club being used. For example, when a golf club having a low loft, such as a driver, wood, or long iron, is being used, the user can open the angle of the rebounder panel 105 relative to the ground in order to allow a golf ball to rebound off of the rebounder panel 105 in the direction of a secondary target. As another example, when a golf club having a high loft, such as a short iron or wedge, is being used, the user can close the angle of the rebounder panel 105 relative to the ground in order to allow a golf ball to rebound off of the rebounder panel 105 in the direction of a secondary target.

Figure 3:
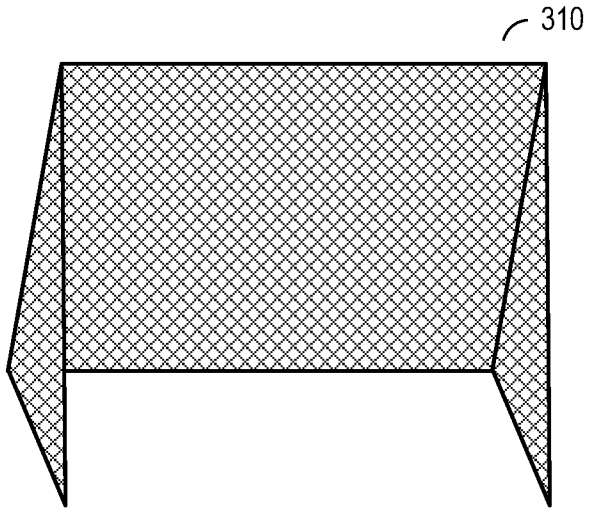
FIG. 3 shows a front view of a secondary target.
Figure 3:
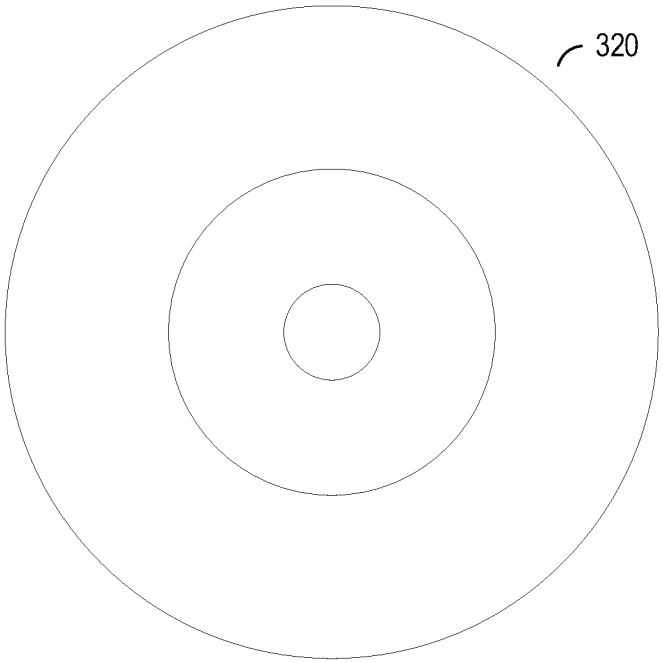

FIG. 3 shows a front view of a secondary target. In some implementations, the secondary target can be a goal 310. For example, the goal 310 can comprise a housing structure and netting. The goal 310 can be operable to catch a ball that lands inside the goal 310. In various implementations, the goal 310 can provide a user with a secondary target. The goal 310 can be placed behind the user (e.g., wherein the user is between the rebounder panel 105 of FIG. 1 and the goal 310) so that when the user hits a straight shot (e.g., a shot that does not put any horizontal rotation on the ball), the struck ball will rebound straight off of the rebounder panel 105 in the direction from which the shot came and land in the goal 310. If a golf shot results in the ball landing in the goal 310, the user can immediately determine that the golf ball was squarely struck by the club face. On the other hand, a poorly stuck ball that comes off the club head with horizontal rotation will rebound off of the rebounder panel 105 and land to the left or the right, depending on the direction of the ball's rotation, of the goal 310. Depending on the position of the ball's landing spot relative to the goal 310, the user can immediately determine the direction and extent of rotation that was placed on the ball by the club face. With a right-handed user, for example, a ball landing to the left of the goal 310 (i.e., the side of the goal 310 closest to the golfer's feet at the time of the swing) will indicate that the ball had clockwise horizontal rotation (e.g., a slice) and a ball landing to the right of the goal 310 (i.e., the side of the goal 310 furthest from the golfer's feet at the time of the swing) will indicate that the ball had counter-clockwise horizontal rotation (e.g., a hook). With a left-handed user, for example, a ball landing to the left of the goal 310 (i.e., the side of the goal 310 furthest from the golfer's feet at the time of the swing) will indicate that the ball had clockwise horizontal rotation (e.g., a hook) and a ball landing to the right of the goal 310 (i.e., the side of the goal 310 closest to the golfer's feet at the time of the swing) will indicate that the ball had counter-clockwise horizontal rotation (e.g., a slice).

In some implementations, the goal 310 can include a center line. For example, a center line (e.g., a drawn or printed line extending along the centerline of the housing structure and netting associated with the goal 310, tape placed at the center of the goal 310, etc.) can allow a user to identify the center point of the goal 310. Moreover, the center line can allow a user to align the center point of the goal 310 with the center point of the rebounder panel 105 of FIG. 1. A user can identify a slight rotation that is placed on a ball based on the position of the ball in the goal 310 relative to the center line. For example, a ball landing in the center of the goal 310 will indicate that the ball was struck squarely with no horizontal rotation enacted on the ball, while a ball landing in either side of the goal 310 will indicate that a slight horizontal rotation was enacted on the ball.

In other implementations, a secondary target can comprise a housing structure and netting with an upward facing target area. For example, the secondary target can be placed in front of a user (e.g., so that the secondary target is between the user and the rebounder panel 105 of FIG. 1), and a ball that is struck squarely at impact can rebound off of the rebounder panel 105 and land in the secondary target. With the secondary target placed in front of the user, the user can see exactly where the ball lands relative to the secondary target without having to pull his or her head up after swinging a golf club.

In still other implementations, the secondary target can be a target mat 320. The target mat 320 can be made from a variety of materials and can comprise an aiming reference point (e.g., a bulls-eye, one or more targeting lines, etc.). The target mat 320 can be placed in front of a user, and a ball that is struck squarely at impact can rebound off of the rebounder panel 105 of FIG. 1 and hit the target mat 320. With the target mat 320 placed in front of the user, the user can see exactly where the ball lands relative to the target mat 320 without having to pull his or her head up after swinging a golf club. Moreover, the user can see exactly where the ball lands on the target mat 320 in order to identify even a slightly off-center shot.

Figure 4:
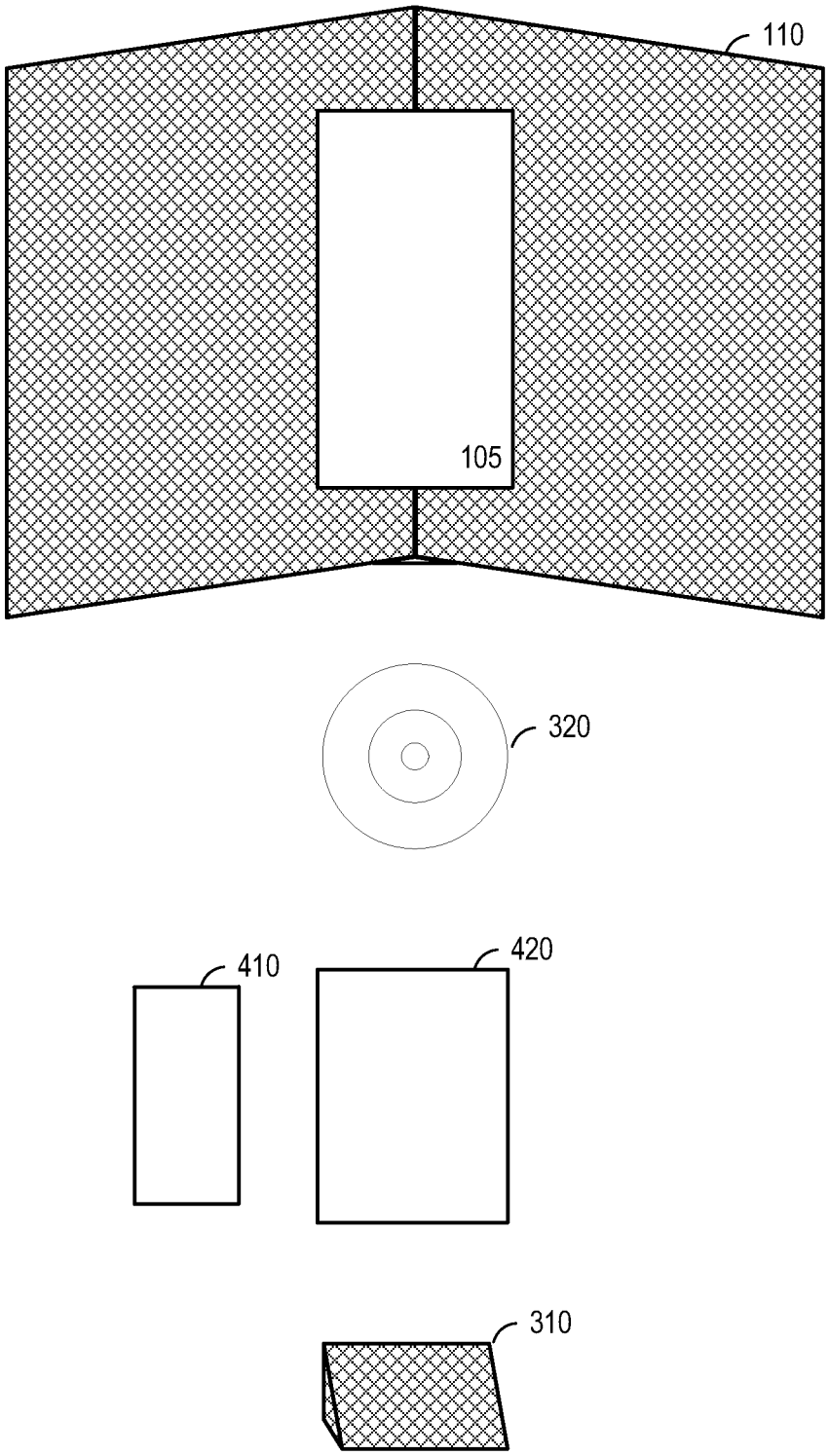
FIG. 4 shows a perspective view of a rebounder panel and surrounding backstop, a stance mat, a tee mat, and a secondary target.

FIG. 4 shows an exemplary layout of a rebounder panel 105 and surrounding backstop 110, a stance mat 410, a launch pad 420, and a goal 310. In some implementations, the launch pad 420 can be positioned between the rebounder panel 105 and the goal 310. In other implementations, the goal 310 can be positioned between the rebounder panel 105 and the launch pad 420.

The launch pad 420 can provide a user with an area to set up a ball to be hit. The launch pad 420 can provide a user with a variety of locations from which to hit a ball depending on the shot that the user wants to practice. For example, simulating a shot from a fairway can be accomplished by placing the ball towards the front of the launch pad 420. In various implementations, the launch pad 420 can comprise an area in which to tee up a golf ball. For example, the launch pad 420 can comprise an area made of a material (e.g., a soft rubber, memory foam, etc.) or having perforations that can accept and hold steady a golf tee. As another example, the launch pad 420 can comprise a rubber tee extending up from the launch pad 420.

In some implementations, the bottom surface of the launch pad 420 can be made of such material so as to allow the launch pad 420 to slide over the ground when the launch pad 420 is impacted by the club head of a golf club. By allowing the launch pad 420 to slide over the ground upon impact by a club head, a user can quickly identify whether the ball was poorly hit. For example, the launch pad 420 can slightly slide or remain stationary if the user hit down on the ball. Moreover, by allowing the launch pad 420 to slide over the ground upon impact by a club head, the force created by the impact can be transferred to the mat, thereby reducing the force of impact that is felt in the user's wrists.

In other implementations, the bottom surface of the launch pad 420 can comprise a material that is operable to preclude the launch pad 420 from sliding over the ground when impacted by a club head. By precluding the launch pad 420 from sliding over the ground, a user will not have to re-adjust the launch pad 420 after each swing.

In some implementations, targeting tape can be temporarily applied to the launch pad 420. For example, target tape can be applied in a straight line running from a desired ball placement position to a desired target (e.g., the targeting tape can run in a straight line pointing to the rebounder panel 105). The targeting tape can provide a user with a visual reference for lining up a golf shot. In some implementations, targeting tape can run from the launch pad 420, to the base of the rebounder panel 105, and up the center of the rebounder panel 105, so as to provide a user with visual reference points to identify where the ball hits the rebounder panel 105 and where the ball lands relative to the straight line created by the targeting tape.

The stance mat 410 can provide a user with an area on which to stand when addressing a ball and when swinging a golf club. The stance mat 410 can be positioned on either side of the launch pad 420, depending on the orientation of the user's golf stance. For example, a right-handed user will position the stance mat 410 to the left (when facing the rebounder panel 105) of the launch pad 420. In some implementations, the stance mat 410 can be made of such material so as to provide a user with a surface that is capable of simulating grass-covered ground (e.g., a rubber mat covered with felt, artificial turf, etc.). In various implementations, the bottom surface of the stance mat 410 can be made of such material as to preclude the stance mat 410 from sliding over the ground when a user swings a golf club.

Figure 5:
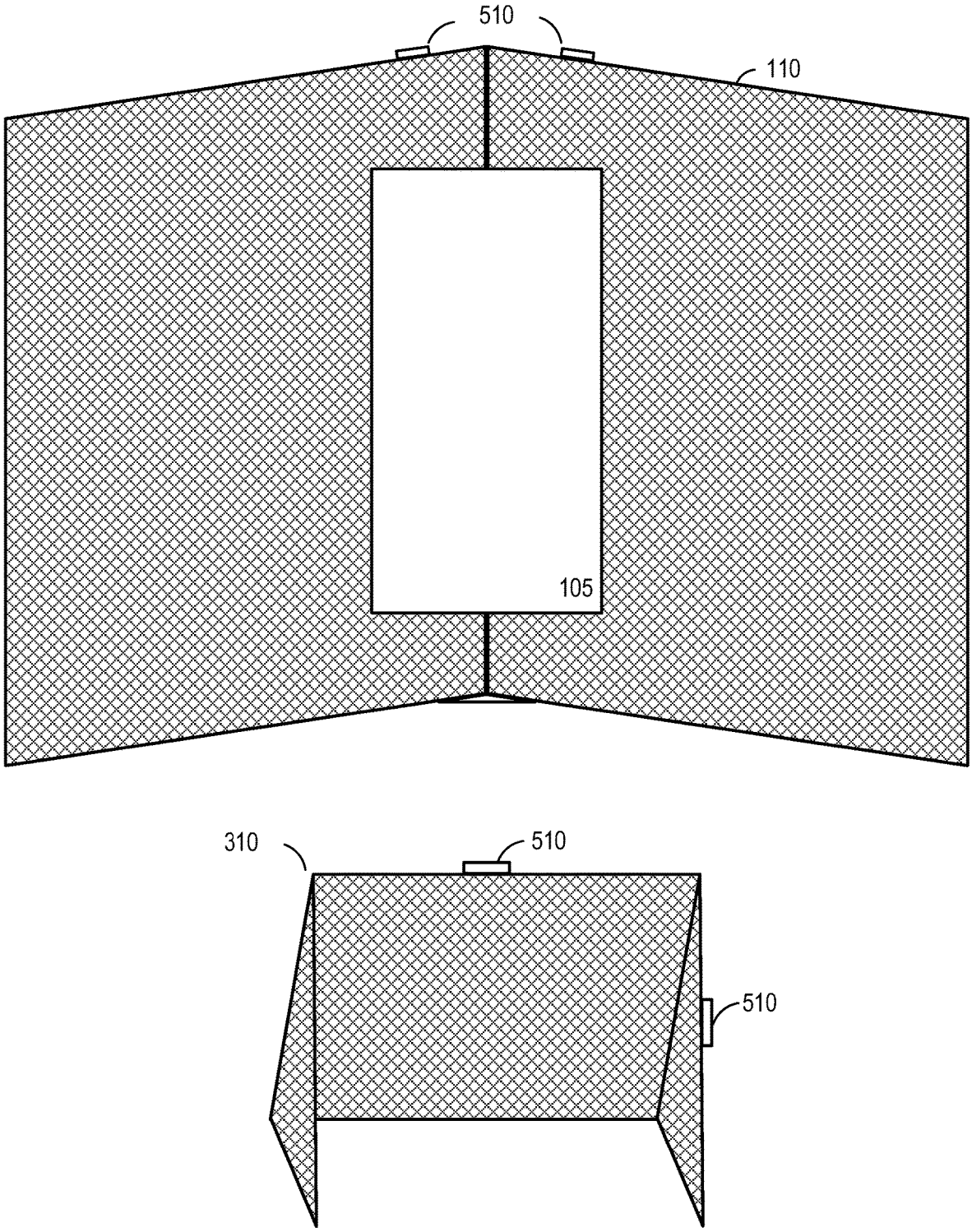
FIG. 5 is a front view of the rebounder panel and the surrounding backstop with one or more sensors attached thereto, as well as a front view of a secondary target with attached sensors.

FIG. 5 is a front view of the rebounder panel 105 and the surrounding backstop 110, as well as a front view of the goal 310. In some implementations, one or more sensors 510 (e.g., motion sensors, speed sensors, pressure sensors, etc.) can be positioned on the rebounder panel 105 and/or the surrounding backstop 110. The one or more sensors 510 can be operable to detect whether a ball strikes the rebounder panel 105, and in some implementations, can be operable to determine where the ball impacted the rebounder panel 105. In various implementations, the one or more sensors 510 can be operable to determine the speed that a ball is traveling prior to impacting the rebounder panel 105 and/or after impacting the rebounder panel 105. The distance that a ball would have traveled had it not impacted the rebounder panel 105 can be determined based on the speed of the ball and the location of the ball's impact on the rebounder panel 105.

In some implementations, pressure sensors can be positioned on the rebounder panel 105. The pressure sensors can be operable to determine the location at which a ball impacts the rebounder panel 105, and can be further operable to measure the force at which the ball impacts the rebounder panel 105. The distance the ball would have traveled can then be calculated from the location and force measured by the pressure sensors.

In some implementations, one or more sensors 510 can be positioned on the goal 310. The one or more sensors 510 can be operable to detect whether a ball lands within the goal 310. Moreover, the one or more sensors 510 can be operable to determine a distance from the location at which a ball enters the goal 310 and the centerline of the goal 310. Based on this distance from the centerline of the goal 310, the extent of horizontal rotation that is enacted on the ball can be determined.

It is, of course, not possible to describe every conceivable combination of components or methodologies for purposes of describing the claimed subject matter, but one of ordinary skill in the art can recognize that further combinations and permutations of such matter are possible. Accordingly, the claimed subject matter is intended to embrace all such alterations, modifications and variations that fall within the spirit and scope of the appended claims.

What is claimed is:

1. An apparatus for use as a target for a practice golf ball comprising:

a flat, rectangular panel operable to redirect the force of the practice golf ball, wherein the panel is positioned at an acute angle with respect to the ground;

a barrier positioned behind the panel, wherein the barrier comprises a first barrier wing and a second barrier wing, each of the first barrier wing and the second barrier wing being covered in netting and being attached to each other at least two hinge points, wherein the at least two hinge points permit the first barrier wing and the second barrier wing to be folded onto one another while encompassing the panel;

a secondary target positioned in front of the panel, wherein the secondary target comprises a goal, the goal comprising a housing structure that is surrounded by netting with the exception of a bottom plane and a front plane of the housing, such that the absence of netting at the front plane of the housing creates an opening operable to accept the practice golf ball when an acceptable amount of horizontal rotation is enacted on the practice golf ball by an impact between the practice golf ball and a face of a golf club;

wherein the secondary target comprises a catching mechanism operable to receive the practice golf ball and retain the practice golf ball, thereby providing a reference point for identifying the terminal point of the flight path of the practice golf ball, and wherein the secondary target is further used to catch the practice golf ball when the practice golf ball rebounds off of the panel with no horizontal rotation; and a tee shot mat, wherein the tee shot mat is between the panel and the secondary target, such that the panel, the tee shot mat, and the secondary target are placed in a straight line respective to each other.

2. The apparatus of claim 1, wherein the panel comprises a material of a type such that when the practice golf ball impacts the panel, the practice golf ball will rebound off of the panel.

3. The apparatus of claim 1, wherein the panel comprises a material of a type such that when the practice golf ball impacts the panel, a temporary indention is made in the panel at the point of impact.

4. The apparatus of claim 1, wherein the barrier comprises a net.

5. The apparatus of claim 1, wherein the secondary target comprises a mat having one or more aiming references, the mat being placed flat on the ground in between the tee shot mat and the panel.

6. The apparatus of claim 1, further comprising a means for attaching the panel to the barrier.

7. The apparatus of claim 6, wherein the means for attaching the panel to the barrier comprises a first rod having a fixed length and a second telescopic rod.

8. The apparatus of claim 1, further comprising one or more sensors operable to detect whether the practice golf ball makes contact with the panel.

9. The apparatus of claim 1, further comprising one or more sensors operable to detect whether the practice golf ball makes contact with the secondary target.

10. An apparatus for use as a target for a practice golf ball comprising:

a panel comprising a first target;

a secondary target positioned in front of the first target, wherein the secondary target comprises a goal, the goal comprising a housing structure that is surrounded by netting with the exception of a bottom plane and a front plane of the housing, such that the absence of netting at the front plane of the housing creates an opening operable to accept the practice golf ball when an acceptable amount of horizontal rotation is enacted on the practice golf ball by an impact between the practice golf ball and a face of a golf club;

a barrier positioned behind the panel;

a rod having a fixed length, wherein one end of the rod is connected to the panel and the other end of the rod is connected to the barrier; and a telescopic rod, wherein one end of the telescopic rod is connected to the panel and the other end of the telescopic rod is connected to the barrier, and wherein the length of the telescopic rod is adjusted to redirect a ball striking the first target back in the direction of the secondary target, and wherein the length of the telescopic rod is adjusted such that the angle of the panel with respect to the ground is an optimal angle based upon the type of golf club being used to hit the practice golf ball.

11. The apparatus of claim 10, further comprising a secondary target.

12. The apparatus of claim 11, wherein the secondary target comprises a goal.

13. A method for using the apparatus of claim 1, the method comprising:

hitting a golf ball from the tee mat, wherein the golf ball strikes the panel in flight and reverses direction upon rebounding off the panel; and determining that a horizontal rotation was placed on the golf ball if the golf ball lands outside of the secondary target.

14. The apparatus of claim 1, wherein the panel is positioned at an angle between seventy-five (75) and eighty-five (85) degrees with the ground.

15. The apparatus of claim 1, wherein the front of the panel is covered with a material operable to transfer a horizontal rotation that is imparted on the practice golf ball before the practice golf ball impacts the panel back to the practice golf ball when the practice golf ball rebounds away from the panel.

16. A method of analyzing a golf club swing, the method comprising:

swinging a golf club and hitting a practice golf ball with a head of the golf club, wherein the practice golf ball is hit from a tee shot mat in the direction of a rectangular panel having a flat surface, the tee shot mat being in between the rectangular panel and a secondary target, such that the rectangular panel, the tee shot mat, and the secondary target are placed in a straight line respective to each other, wherein the rectangular panel is:

positioned at an acute angle with respect to the ground;

positioned in front of a barrier comprising a first barrier wing and a second barrier wing, each of the first barrier wing and the second barrier wing being covered in netting and being attached to each other at least two hinge points, wherein the at least two hinge points permit the first barrier wing and the second barrier wing to be folded onto one another while encompassing the rectangular panel;

wherein the practice golf ball bounces off of the rectangular panel in the direction of the secondary target, the secondary target comprising a goal, wherein the goal comprises a housing structure that is surrounded by netting with the exception of a bottom plane and a front plane of the housing, such that the absence of netting at the front plane of the housing creates an opening operable to accept the practice golf ball;

determining that no horizontal rotation or an acceptable amount of horizontal rotation was enacted on the practice golf ball by the head of the golf club if the practice golf ball lands within the secondary target;

determining that an acceptable amount of clockwise horizontal rotation was enacted on the practice golf ball by the head of the golf club if the practice golf ball is caught within a first side of the secondary target; and determining that an acceptable amount of counterclockwise horizontal rotation was enacted on the practice golf ball by the head of the golf club if the practice golf ball is caught within a second side of the secondary target.

* * * * *